US011920302B2

(12) United States Patent
Collins

(10) Patent No.: US 11,920,302 B2
(45) Date of Patent: Mar. 5, 2024

(54) WOVEN PAPERMAKING FABRIC HAVING DISCRETE CROSS-MACHINE DIRECTION PROTUBERANCES

(71) Applicant: Kimberly-Clark Worldwide, Inc., Neenah, WI (US)

(72) Inventor: Lynda Ellen Collins, Neenah, WI (US)

( * ) Notice: Subject to any disclaimer, the term of this patent is extended or adjusted under 35 U.S.C. 154(b) by 112 days.

(21) Appl. No.: 17/279,423

(22) PCT Filed: Sep. 28, 2018

(86) PCT No.: PCT/US2018/053271
§ 371 (c)(1),
(2) Date: Mar. 24, 2021

(87) PCT Pub. No.: WO2020/068091
PCT Pub. Date: Apr. 2, 2020

(65) Prior Publication Data
US 2022/0010491 A1 Jan. 13, 2022

(51) Int. Cl.
*D03D 13/00* (2006.01)
*D21F 7/08* (2006.01)

(52) U.S. Cl.
CPC ..... *D21F 7/08* (2013.01); *D03D 13/00* (2013.01); *D03D 13/004* (2013.01)

(58) Field of Classification Search
CPC ... D21F 7/08; D21F 5/18; D21F 11/00; D21F 1/00; D03D 13/00; D03D 13/004
See application file for complete search history.

(56) References Cited

U.S. PATENT DOCUMENTS 4,191,609 A * 3/1980 Trokhan ..... D21H 25/005 162/207
5,228,482 A * 7/1993 Fleischer ..... D21F 1/0027 139/383 A (Continued)

FOREIGN PATENT DOCUMENTS

CN 2885922 Y 4/2007
CN 204000435 U 12/2014

(Continued)

OTHER PUBLICATIONS

Co-pending U.S. Appl. No. 16/650,058, filed Mar. 24, 2020, by Collins et al. for "Woven Papermaking Fabric Including Stablilized Weave Providing Textured Contacting Surface."

(Continued)

*Primary Examiner* — Robert H Muromoto, Jr.
(74) *Attorney, Agent, or Firm* — KIMBERLY-CLARK WORLDWIDE, INC.

(57) ABSTRACT

The woven papermaking fabrics have a machine direction (MD) axis and a cross-machine direction (CD) axis, a machine contacting surface and a web contacting surface. The web contacting surface comprises a plurality of MD and CD oriented protuberances. Generally, the MD oriented protuberances are formed from warp filaments and may be continuous across one dimension of the papermaking fabric. The CD oriented protuberances are formed from shute filaments and are discrete. The fabrics may be woven such that the CD oriented protuberances traverse at least one MD oriented protuberance and in other instances two or more MD oriented protuberances. In addition to MD and CD oriented protuberances, the web contacting surface comprises valleys disposed between adjacent MD oriented protuberances. The valleys are generally permeable to air and (Continued)

water and aid in the formation and structuring of webs manufactured using the fabrics.

30 Claims, 9 Drawing Sheets

(56) References Cited

U.S. PATENT DOCUMENTS 5,240,763 A * 8/1993 Wagner ..... D21F 1/0027 162/902
5,449,026 A * 9/1995 Lee ..... D21F 7/083 139/383 A
5,456,293 A * 10/1995 Ostermayer ..... D21F 1/0027 139/383 A
5,520,225 A * 5/1996 Quigley ..... D21F 1/0027 139/383 A
5,713,397 A * 2/1998 Quigley ..... D21F 11/006 139/383 A
5,817,400 A * 10/1998 Chen ..... A61F 13/533 264/284
5,832,962 A * 11/1998 Kaufman ..... D21F 11/006 162/902
5,906,306 A * 5/1999 Rajala ..... B65H 20/12 156/496
6,402,895 B1 * 6/2002 Best ..... D21F 1/0027 162/902
6,592,714 B2 7/2003 Lamb
6,660,362 B1 * 12/2003 Lindsay ..... D21F 11/145 162/902
6,673,202 B2 * 1/2004 Burazin ..... D21F 5/18 162/122
6,991,706 B2 * 1/2006 Lindsay ..... D21H 27/30 162/134
7,166,189 B2 * 1/2007 Burazin ..... D21F 11/14 162/902
7,235,156 B2 * 6/2007 Baggot ..... B31F 1/07 162/111
7,294,229 B2 * 11/2007 Hada ..... D21F 11/006 428/156
7,300,543 B2 * 11/2007 Mullally ..... D21F 11/006 428/156
7,323,072 B2 * 1/2008 Engelhart ..... D04H 1/542 156/73.2
7,611,605 B2 11/2009 Burazin et al.
7,611,607 B2 11/2009 Mullally et al.
7,726,349 B2 6/2010 Mullally et al.
7,935,409 B2 * 5/2011 Burazin ..... D21H 27/002 428/174
9,259,075 B2 * 2/2016 Gordon ..... A47K 7/02
10,280,567 B2 * 5/2019 Vogt ..... D21H 27/02
10,349,799 B2 * 7/2019 Bradley ..... B32B 7/08
10,385,511 B2 * 8/2019 Burazin ..... D21H 27/002
10,563,353 B2 * 2/2020 Collins ..... D03D 15/567
10,927,506 B2 * 2/2021 Zanon ..... A47K 10/16
11,313,079 B2 * 4/2022 Collins ..... D21F 11/14
11,377,793 B2 * 7/2022 Collins ..... D21F 5/18
11,377,797 B2 * 7/2022 Collins ..... D21H 27/02
11,421,384 B2 * 8/2022 Rekoske ..... D21F 5/182
2001/0032712 A1 * 10/2001 Friedbauer ..... B31F 1/07 162/361
2002/0056536 A1 * 5/2002 Lamb ..... D21F 11/14 162/903
2003/0079850 A1 * 5/2003 Rougvie ..... D21F 1/0027 442/212
2003/0084952 A1 * 5/2003 Burazin ..... D21F 1/0036 162/902
2007/0209770 A1 * 9/2007 Barrett ..... D21F 11/14 162/358.2
2008/0110591 A1 * 5/2008 Mullally ..... D21F 11/006 162/358.2
2008/0169040 A1 * 7/2008 Barrett ..... D21F 1/0036 162/903
2009/0065166 A1 * 3/2009 Quigley ..... D21F 1/0027 139/420 R
2009/0205797 A1 8/2009 Fernandes et al.
2009/0211722 A1 8/2009 Crook et al.
2014/0231039 A1 * 8/2014 Patel ..... D21F 1/0027 162/289
2016/0215451 A1 * 7/2016 Uymur ..... D21F 1/0036
2017/0211235 A1 * 7/2017 Lamb ..... D21H 27/02
2019/0360152 A1 * 11/2019 Collins ..... D21F 11/006
2020/0240081 A1 * 7/2020 Collins ..... D21F 1/0036
2020/0291575 A1 * 9/2020 Collins ..... D21F 1/0036
2020/0291577 A1 * 9/2020 Collins ..... D21F 11/006
2020/0291578 A1 * 9/2020 Collins ..... D21F 11/006
2020/0340180 A1 * 10/2020 Burazin ..... B65G 15/42
2022/0010490 A1 * 1/2022 Collins ..... D21F 1/00
2022/0010491 A1 * 1/2022 Collins ..... D03D 13/004

FOREIGN PATENT DOCUMENTS

CN 206438338 U 8/2017
WO 0012817 A1 3/2000
WO 13023276 A1 2/2013
WO 20068091 A1 4/2020
WO 20068092 A1 4/2020

OTHER PUBLICATIONS

Co-pending U.S. Appl. No. 16/650,065, filed Mar. 24, 2020, by Collins et al. for "Woven Papermaking Fabric Having Converging, Diverging or Merging Topography."
Co-pending U.S. Appl. No. 16/650,068, filed Mar. 24, 2020, by Collins et al. for "Woven Papermaking Fabric Having Machine and Cross-Machine Oriented Topography."
Co-pending U.S. Appl. No. 16/650,050, filed Mar. 24, 2020, by Collins et al. for "Twill Woven Papermaking Fabrics."
Co-pending U.S. Appl. No. 17/279,409, filed Mar. 24, 2021, by Collins et al. for "Woven Papermaking Fabric Having Intersecting Twill Patterns."

* cited by examiner

WOVEN PAPERMAKING FABRIC HAVING DISCRETE CROSS-MACHINE DIRECTION PROTUBERANCES

BACKGROUND OF THE INVENTION

In the manufacturing of tissue products, particularly absorbent tissue products such as bath tissue and facial tissue products, there is a continuing need to improve the physical properties of the tissue and offer a differentiated product appearance. It is generally known that molding a partially dewatered cellulosic web on a topographical papermaking fabric will enhance the finished paper product's physical properties, such as sheet bulk, stretch and softness, and aesthetics. Such molding can be applied by fabrics in a through-air dried process, such as the process disclosed in U.S. Pat. No. 5,672,248, or in a wet-pressed tissue manufacturing process, such as that disclosed in U.S. Pat. No. 4,637,859.

Exemplary papermaking fabrics are disclosed in U.S. Pat. No. 6,998,024, which teaches woven papermaking fabrics with substantially continuous machine direction ridges whereby the ridges are made up of multiple warp filaments grouped together. The ridges are higher and wider than individual warps. The wide wale ridges have a ridge width of about 0.3 cm or greater and the frequency of occurrence of the ridges in the CD is from about 0.2 to 3 per centimeter. In the examples shown, the shute diameters are either larger than or smaller than the warp diameters but only one shute diameter is utilized.

Other woven papermaking fabrics are disclosed in U.S. Pat. No. 7,611,607, which teaches fabrics having substantially continuous, not discrete, machine-direction ridges separated by valleys, where the ridges are formed of multiple warp filaments grouped together and supported by multiple shute strands of two or more diameters. The ridges are generally oriented parallel to the machine direction axis of the fabric, however, in certain instances the ridges are oriented at an angle of about 5 degrees relative to the machine direction axis. In those instance where the ridges are angled relative to the machine direction axis, they may be woven so as to regularly reverse direction in terms of movement in the cross-machine direction, creating a wavy appearance which can enhance aesthetics of the resulting tissue product. While the ridges could be angled with respect to the machine direction axis, the degree of orientation is limited. Moreover, the ridges could not be woven to a have a height that was substantially continuous along their length.

Thus, the prior art woven papermaking fabrics have generally been limited to topographies oriented substantially in the machine direction, with some small degree of variability. Machine direction oriented topography presents several problems primarily in fabric manufacturing and in limitations in aesthetic appearances that can be created. Machine direction oriented topography often relies upon warp filaments to form machine direction oriented ridges with fewer interchanges than warp filaments in the adjacent valleys causing differences in warp tension. The tension differences often result in warps in the ridges of the fabric becoming slack and ceasing to weave. Once a warp yarn ceases to weave into the fabric, they become so slack that they are in danger of being broken by the projectile of the loom. Thus, there remains a need in the art for a new weave structure to address the limitations of current weave structures for woven paper machine clothing.

SUMMARY

The present inventors have now discovered new weave structures for the manufacture of woven papermaking fabrics that allow the web contacting surface of the fabric to be woven with three-dimensional topography comprising protuberances oriented in both the machine (MD) and cross-machine (CD) direction. The MD oriented protuberances may be woven from two or more adjacent warp filaments and, in certain instances, be oriented at an angle relative to the machine direction axis of the fabric. The MD oriented protuberances may be continuous or discrete. Preferably the CD protuberances are discrete and may be formed from shute filaments woven above or below the warp filaments forming the MD oriented protuberances.

At certain points along its length the MD oriented element is intersected by a CD oriented protuberance, the upper surface of which may be coplanar with the upper most surface of the MD oriented element, or may lie above or below the upper most surface of the MD oriented element. Generally the CD oriented protuberances have a first and a second end and do not extend across any one dimension of the fabric. As such, the CD oriented protuberances, which may be formed from a portion of a shute filament woven above a corresponding warp for a float length from 5 to 20, are generally discrete and have a length from about 1.0 to about 10 mm, such as from about 2.0 to about 8.0 mm and more preferably from about 3.0 to about 5.0 mm.

Accordingly, in one embodiment the present invention provides a woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a plurality of MD oriented protuberances formed from two or more warp filaments woven above their corresponding shute filaments, each of the plurality of MD oriented protuberances spaced apart from one another to define valleys there between, and a plurality of discrete CD oriented protuberances formed from at least one shute filament woven about a corresponding warp filament.

In other embodiments the present invention provides a woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a plurality of MD oriented protuberances formed from two or more warp filaments and a plurality of discrete CD oriented protuberances formed from at least one shute filament disposed thereon, the plurality of MD oriented protuberances are spaced apart from one another to define a plurality of valleys there between. In certain instances the CD oriented protuberance has an upper surface lying in a first upper surface plane and the MD oriented protuberance has an upper surface lying in a second upper surface plane, wherein the first upper surface plane is above the second upper surface plane.

In still other embodiments the present invention provides a weave pattern which yields woven papermaking fabrics having a plurality of substantially CD oriented protuberances disposed on the web contacting surface thereof. In certain instances the CD oriented protuberances are discrete and woven in a regular, repeating pattern. The CD oriented protuberances may vary in length (measured along the major axis of the CD oriented protuberance), but are generally greater than about 0.5 mm and more preferably greater than about 1.0 mm, such as from about 0.5 to about 10 mm and more preferably from about 1.0 to about 5.0 mm and still more preferably from about 2.0 to about 4.0 mm. The CD oriented protuberances may comprise a single shute filament woven above corresponding warp filaments, or may comprise two or more shute filaments woven together to form CD oriented protuberances having a greater height.

In still other embodiments the present invention provides a woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having first and second spaced apart MD oriented protuberances and first and second CD oriented protuberances spaced apart from each other in the MD and intersecting the first and second MD oriented protuberances, the first and second MD oriented protuberances and the first and second CD oriented protuberances defining a discrete parallelogram shaped valley there between.

In yet other embodiments the present invention provides a woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having MD oriented protuberances woven from two or more adjacent warp filaments and CD oriented protuberances comprising at least one shute filament woven over the two or more adjacent warp filaments forming the MD oriented protuberance, the at least one shute filament having an upper surface lying in a first fabric upper surface plane.

DEFINITIONS

Figure 1:
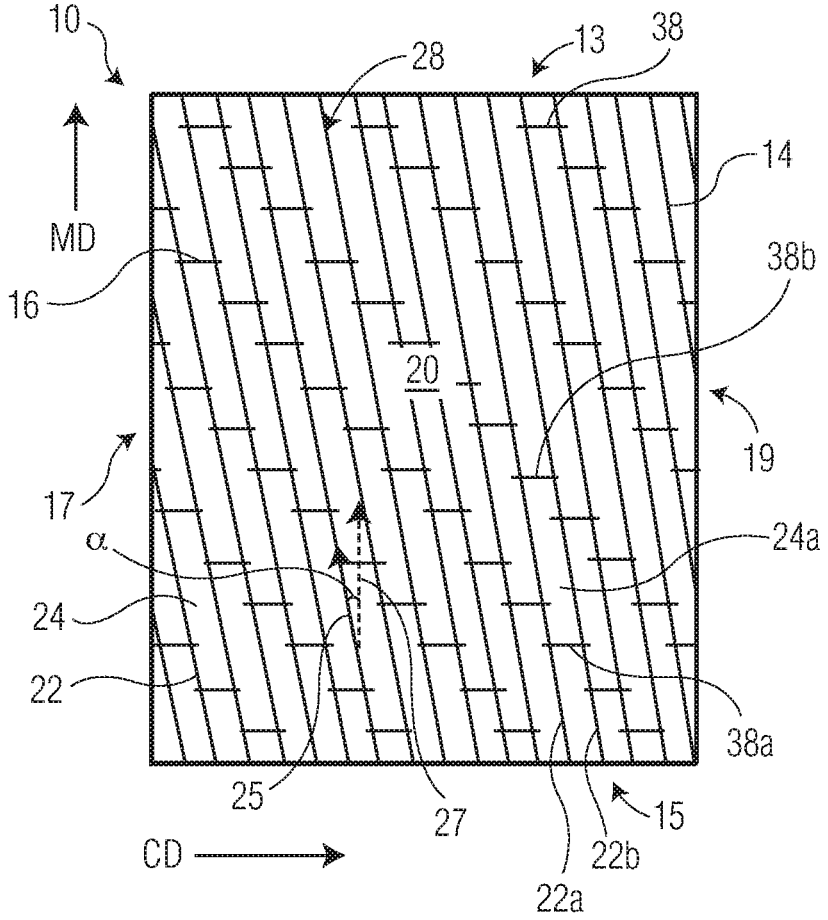
FIG. 1 is a top view of a woven papermaking fabric having a three-dimensional fabric contacting surface according to one embodiment of the present invention.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulosic web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as a through-air drying fabric as described in U.S. Pat. Nos. 5,429,686, 6,808,599 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warps" generally refers to machine direction filaments and the term "shutes" generally refers to cross-machine direction filaments, although it is known that fabrics can be manufactured in one orientation and run on a paper machine in a different orientation.

As used herein, the term "directly adjacent" when referring to the relation of one filament to another means that no other filaments are disposed between the referenced filaments. For example, if two warp filaments forming a portion of a protuberance are said to be directly adjacent to one another no other warp filaments are disposed between the two protuberance forming warp filaments.

As used herein, the term "protuberance" generally refers to a three-dimensional element formed by one or more warp filaments overlaying a plurality of shute filaments, such as in the case of MD orientated protuberances, or one or more shute filaments woven above their corresponding warp filaments, such as in the case of CD orientated protuberances. Protuberances may be referred to herein alternatively as three-dimensional elements or simply as elements.

As used herein, the term "protuberance forming portion" refers to the woven warp or shute filaments that form a portion of the protuberance. In certain instances the protuberance forming portion may comprise a plurality of adjacent warp/shute filament interchanges that are woven such that the warp filaments are woven above their respective shute filaments. The protuberance forming portion may extend substantially in the machine direction and extend over at least five shute filaments in the machine direction, or at least seven shute filaments, or at least ten shute filaments.

As used herein, the term "valley" generally refers to a portion of the web contacting surface of the papermaking fabric lying between adjacent protuberances.

As used herein, the "valley bottom" is defined by the top of the lowest visible yarn which a tissue web can contact when molding into the textured, fabric. The valley bottom can be defined by a warp knuckle, a shute knuckle, or by both. The "valley bottom plane" is the z-direction plane intersecting the top of the elements comprising the valley bottom.

As used herein, the term "valley depth" generally refers to z-directional depth of a given valley and is the difference between C2 (95 percentile height) and C1 (5 percentile height) values, having units of millimeters (mm), as measured by profilometry and described in the Test Method section below. In certain instances valley depth may be referred to as S90. To determine valley depth a profilometry scan of a fabric is generated as described herein, from which a histogram of the measured heights is generated, and an S90 value (95 percentile height (C2) minus the 5 percentile height (C1), expressed in units of mm) is calculated. Generally the instant fabrics have relatively deep valleys, such as valleys having valley depths greater than about 0.30 mm, more preferably greater than about 0.35 mm and still more preferably greater than about 0.40 mms, such as from about 0.30 to about 1.0 mm.

As used here, the term "valley width" generally refer to the width of a valley disposed on a fabric according to the present invention and is the Psm value, having units of millimeters (mm), as measured by profilometry and described in the Test Method section below. Generally valley width is measured along a line drawn normal to the machine direction axis of the fabric that intersects at least two adjacent MD orientated protuberances. The valley width of a given fabric may vary depending on the weave pattern, however, in certain instances the valley width may be greater than about 1.0 mm, more preferably greater than about 1.5 mm and still more preferably greater than about 2.0 mm, such as from about 2.0 to about 5.0 mm.

As used herein, the term "element angle" generally refers to the orientation of protuberances relative to the MD axis of the fabric. Element angle is generally measured by profilometry and described in the Test Method section below. In certain instances the MD protuberances of the present invention may have an element angle from 0 to about ±20 degrees. In certain instances the MD protuberances have an element angle that is greater than 0, such as greater than about 0.5 degrees, more preferably greater than about 2.0 degrees and still more preferably greater than about 4.0 degrees, such as from about 0.5 to about 20 degrees.

As used herein, the term "wall angle" generally refers to the angle formed between a given valley bottom and an adjacent machine direction (MD) orientated protuberance and is the Pdq value, having units of degrees (°), as measured by profilometry and described in the Test Method section below. Generally wall angle is measured along a line drawn normal to the machine direction axis of the fabric that intersects at least two adjacent MD orientated protuberances. The instant fabrics may have MD orientated protuberances with relatively steep wall angles, such as wall angles greater than about 20 degrees and more preferably greater than about 22 degrees and still more preferably greater than about 24 degrees, such as form about 20 to about 45 degrees and more preferably from about 22 to about 40 degrees.

As used herein the term "discrete" when referring to an element of a papermaking fabric according to the present invention, such as a CD oriented protuberance, means that the element is visually unconnected from other elements and does not extend continuously in any dimension of the papermaking fabric surface.

As used herein, the term "discrete protuberance" refers to separate, unconnected three-dimensional elements disposed on a papermaking fabric that do not extend continuously in any dimension of the fabric. A protuberance may be discrete despite being formed from a single continuous filament. For example, a single continuous shute filament may be woven such that it forms a plurality of discrete CD oriented protuberances where each protuberance has a first proximal end and a first distal end where the ends of the protuberance terminate at spaced apart warp filaments.

As used herein the term "continuous" when referring to a three-dimensional element of a papermaking fabric according to the present invention, such as a protuberance or a pattern, means that the element extends throughout one dimension of the papermaking fabric surface. When referring to a protuberance the term refers to a protuberance comprising two or more warp filaments that extends without interruption throughout one dimension of the woven fabric.

As used herein, the term "uninterrupted" generally refers to a protuberance having an upper surface plane that extends without interruptions and remains above the valley bottom plane for the length of the protuberance. Undulations of the upper surface plane within a protuberance along its length such as those resulting from twisting of warp filaments or warp filaments forming the protuberance tucking under one another are not considered to be interruptions.

As used herein the term "line element" refers to a three-dimensional element of a papermaking fabric, such as a protuberance, in the shape of a line, which may be continuous, discrete, interrupted, and/or a partial line with respect to a fabric on which it is present. The line element may be of any suitable shape such as straight, bent, kinked, curled, curvilinear, serpentine, sinusoidal, and mixtures thereof. In one example, a line element may comprise a plurality of discrete elements that are oriented together to form a visually continuous line element.

As used herein the term "pattern" refers to any non-random repeating design, figure, or motif. Generally the fabrics of the present invention may comprise decorative patterns comprising a plurality of line elements, however, it is not necessary that the line elements form recognizable shapes, and a repeating design of the line elements is considered to constitute a decorative pattern.

As used herein the term "twill pattern" generally refers to a pattern of continuous, parallel, spaced apart MD orientated protuberances having a non-zero element angle. In a twill pattern the MD oriented protuberances are woven from two or more directly adjacent warp filaments having a paired portion having a float length from 2 to 8.

DETAILED DESCRIPTION

The present inventors have now surprisingly discovered that certain woven papermaking fabrics, and in particular woven transfer and through-air drying (TAD) fabrics, having patterns disposed thereon may be used to produce tissue webs and products having high bulk and visually appealing aesthetics without compromising operating efficiency. Papermaking fabrics of the current invention are generally directed to woven fabrics but may be suitable as base fabrics upon which to add additional material to enhance tissue physical properties or aesthetics. For example, the instant woven fabrics may be used in the manufacture of a papermaking fabric having a foraminous woven base member surrounded by a hardened photosensitive resin framework. In other instances the instant woven fabrics may be used in the manufacture of a papermaking fabric having a foraminous woven base member with a polymeric material disposed thereon by printing, extruding or well-known additive manufacturing processes.

The present fabrics may be used in the manufacture of a broad range of fibrous structures, particularly wet-laid fibrous structures and more particularly, wet-laid tissue products such as bath tissues, facial tissues, paper towels, industrial wipers, foodservice wipers, napkins and other similar products. Further, the inventive fabrics are well suited for use in a wide variety of tissue manufacturing processes. For example, the fabrics may be used as TAD fabrics in either uncreped or creped applications to generate aesthetically acceptable patterns and good, bulky tissue product attributes. Alternatively, the fabrics may be used as impression fabrics in wet-pressed papermaking processes.

Accordingly, in one embodiment, the invention resides in a woven papermaking fabric having a machine direction (MD) axis and a cross-machine direction (CD) axis, a machine contacting surface and a web contacting surface where the web contacting surface is textured and comprises a first plurality of protuberances oriented in the MD of the fabric and a second plurality of protuberances that are oriented in the CD of the fabric. In certain instances the MD oriented protuberances are continuous and have a non-zero element angle and the CD oriented protuberances are discrete and intersect the continuous MD oriented protuberances.

The fabrics are generally formed from interwoven shute and warp filaments, where the MD oriented protuberances are formed from a plurality of warp filaments woven above their corresponding shute filaments and the CD oriented protuberances are formed from one or more shute filaments, which may be woven above their corresponding warp filaments. Depending on the intended application of the papermaking fabrics, the shute count may be from about 10 to about 80 ends per inch, more preferably from about 20 to about 60 ends per inch, and still more preferably from about 25 to about 40 ends per inch.

The MD oriented protuberances, which are formed from woven warp filaments, may be continuous or discrete. In a particularly preferred embodiment the MD oriented protuberances are continuous and have a width of from about 0.2 to about 2.5 mm, such as from about 0.5 to about 2.0 mm and the frequency of occurrence of the MD oriented protuberances in the cross-machine direction of the fabric is from about 0.5 to about 8 per centimeter, such as from about 3.2 to about 7.9 per centimeter, such as from about 4.2 to about 5.3 per centimeter.

The MD oriented protuberances are further to have a height, generally measured as the z-directional length between the uppermost surface of a warp filament forming the protuberance and the valley bottom plane. In certain instances the height may range from about 250 to about 350 percent of the diameter of the warp strand forming the protuberance, such as from about 260 to about 300 percent of the warp strand diameter. In other instances, where warp strands of multiple diameters are used to weave the protuberance, the height may be from about 105 to about 125 percent of the weighted-average shute diameters. Warp filaments useful in weaving the MD protuberances may have a diameter from about 0.2 to about 0.7 mm, such as from about 0.3 to about 0.5 mm.

While in certain embodiments, the MD oriented protuberances may be aligned with the MD axis of the fabric, in other embodiments the MD oriented protuberances may have a non-zero element angle. For example, the warp filaments may be woven to form protuberances that form a twill pattern that extends in a continuous manner across the fabric. The twill pattern is formed from parallel protuberances having a principal axis that while generally oriented in the MD are slightly skewed to provide a non-zero element angle, such as an element angle from about 0.5 to about 20 degrees. Between adjacent protuberances are valleys, which may also be continuous like the protuberances that bound them, oriented at an angle relative to the machine direction axis. In a particularly preferred embodiment the protuberances forming the twill pattern are linear and provide valleys having linear sidewalls.

In those embodiments where the MD protuberances are woven in a twill pattern, the adjacent warp filaments forming the MD protuberances are woven such that they are laterally offset from one another in the machine direction. In this manner the distal end of a first warp filament and the proximal end of a directly adjacent warp filament overlap to an extent to form a paired portion. The paired portion may have a float length from two to ten and more preferably from three to eight. Weaving the warp filaments in this paired, offset, manner allows the end of one warp float to tuck under the next machine direction oriented warp float. As a result the weave pattern yields MD oriented protuberances comprising warp stacks with a degree of symmetry where warps are introduced and ended in uniform spacing.

The twill woven MD protuberance may comprise two, three, four or more warp filaments above their corresponding shute filaments. The warp filaments may extend over at least four shute filaments in the machine direction, or at least seven shute filaments, or at least ten shute filaments. In certain embodiments the warp may extend four to fifty shute filaments, such as from six to forty shute filaments. When referring to the number of shute floats traversed by the warp filaments forming a given element the term "float length" will be used. For example, a warp filament forming the protuberance that extends substantially in the machine direction over five shute filaments is said to have a float length of five.

In a particularly preferred embodiment the MD oriented protuberances are arranged in a continuous twill pattern, extending from a first lateral edge of the fabric to a second lateral edge, in which adjacent protuberances are generally parallel to one another. Between adjacent protuberances are valleys. The protuberances generally define a pair of spaced apart, parallel, valley sidewalls and as such the valleys may be oriented at an angle relative to the machine direction axis.

In other embodiments the MD oriented protuberances may be substantially continuous and woven from two or more warp filaments grouped together and supported by multiple shute strands of two or more diameters, such as the woven fabrics described in U.S. Pat. No. 7,611,607, the contents of which is incorporated herein in a manner consistent with the present disclosure. MD protuberances woven in this manner can be oriented at an angle of from 0 to about ±15 degrees relative to the true machine direction of the fabric, i.e., the element angle may range from 0 to about ±15 degrees. Accordingly, in certain instances the MD oriented protuberances may be aligned parallel to the MD axis of the fabric (having an element angle of 0). In other instances the MD oriented protuberances may have an element angle from 0 to about ±15 degrees, such as from 0 to about ±10 degrees, such as from 0 to about ±5 degrees.

In still other embodiments the MD oriented protuberances may be substantially continuous and have segments with variable element angles. The protuberances may be formed of multiple warp strands grouped together and supported by multiple shute strands of two or more diameters, wherein the warp strands are substantially oriented in the machine direction and wherein each individual warp strand participates in both the protuberances and the valleys disposed there between. In certain instances the element angle may be varied in a regular fashion to yield a protuberance having a wavy appearance.

The MD oriented protuberances can be configured substantially the same in terms of any one or more characteristics of height, width, length or element angle. For example, in certain embodiments, substantially all the MD oriented protuberances have substantially similar characteristics of height, width and element angle. In other embodiments however, the MD oriented protuberances may be configured such that one or more characteristics of height, width, or length of the protuberances vary from one MD oriented protuberance to another MD oriented protuberance.

The fabric further comprises a plurality of second protuberances, which may comprise discrete CD oriented protuberances aligned parallel to the CD axis of the fabric. While in certain instances the plurality of second protuberances may be aligned parallel to the CD axis of the fabric, one skilled in the art will appreciate that the weave patterns may be readily adapted to form protuberances oriented at a slight angle relative to the CD axis of the fabric. Thus, in certain embodiments the invention provides a woven papermaking fabric comprising a plurality of CD oriented protuberances oriented an angle from about 0 to about 5 degrees relative to the CD axis of the fabric.

The CD oriented protuberances are generally woven from shute filaments, a portion of which is woven above its corresponding warp filament. In certain instances the CD oriented protuberances may have a float length from 3 to 20, such as from 5 to 15. The CD oriented protuberances may be woven such that they are woven above the warp filaments forming the MD protuberances, or they may be woven such that they are woven beneath the warp filaments forming the MD protuberances.

The CD oriented protuberances may be woven from one, two or three shute filaments woven above their corresponding warp filaments. The fabric may be woven such that the CD oriented protuberances are discrete and occur in a regular, repeating pattern. For example, the CD oriented protuberances may be arranged in a staggered pattern, spaced apart from one another in the MD by at least one shute filament. Regardless of the pattern of CD protuberances, the protuberances generally traverse at least one MD oriented protuberance and in certain instances two or more adjacent MD oriented protuberances.

In those embodiments where the CD protuberances traverse more than one MD oriented protuberances, the CD protuberances may be spaced apart from one another in the machine direction such that discrete valleys are formed between the MD and CD protuberances. In this manner the spaced apart CD protuberances may form the valley end walls and the spaced apart MD protuberances may form the valley sidewalls.

Figure 2:
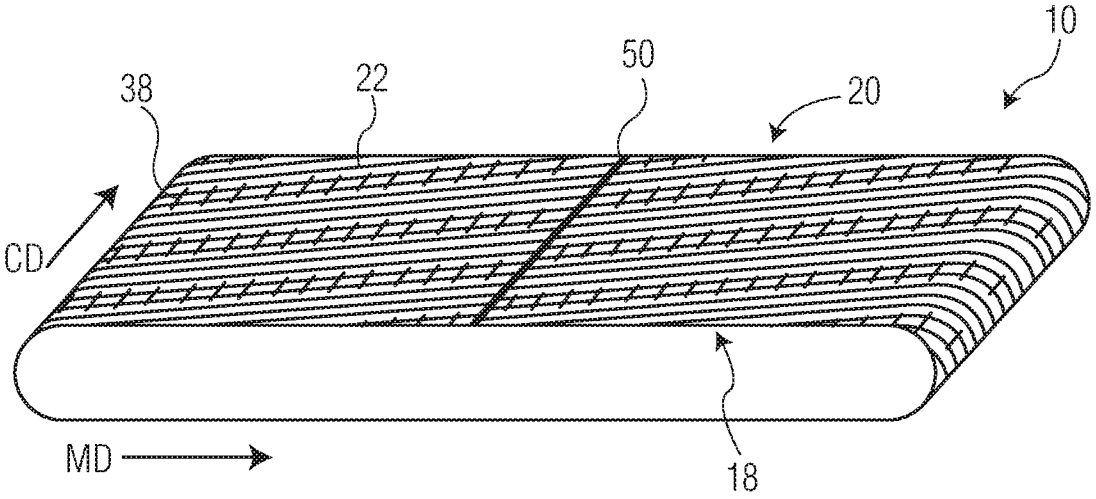
FIG. 2 illustrates the woven papermaking fabric of FIG. 1 in seamed configuration.

With reference now to FIGS. 1 and 2, one embodiment of a papermaking fabric 10 according to the present invention is illustrated. The fabric 10 has two principal dimensions—a machine direction (MD), which is the direction within the plane of the fabric 10 parallel to the principal direction of travel of the tissue web during manufacture and a cross-machine direction (CD), which is generally orthogonal to the machine direction. The papermaking fabric 10 generally comprises a plurality of filaments that can be woven together. The papermaking fabric can include a first longitudinal end 13 and a second longitudinal end 15 that can be joined by a seam 50, as shown in FIG. 2, to form an endless belt. As will be described in further detail below, the filaments can include a plurality of warp filaments 14 and a plurality of shute filaments 16 that can be woven together to form a machine contacting surface 18 and a web contacting surface 20 of the woven papermaking fabric 10.

The web contacting surface can be opposite from the machine contacting surface. Machinery employed in a typical papermaking operation is well known in the art and may include, for example, vacuum pickup shoes, rollers, and drying cylinders. In a preferred embodiment, the papermaking fabric comprises a through-air drying fabric useful for transporting an embryonic tissue web across drying cylinders during the tissue manufacturing process. However, in other embodiments, the woven papermaking fabric can comprise a transfer fabric for transporting an embryonic tissue web from forming wires to a through-air drying fabric. In these embodiments, the web contacting surface supports the embryonic tissue web, while the opposite surface, the machine contacting surface, contacts the surrounding machinery.

With continued reference to FIG. 1, the web contacting surface 20 of the fabric 10 comprises a plurality of first protuberances 22 and second protuberances 38. The first protuberances 22 are substantially oriented in the machine direction (MD) and may be referred to herein as MD oriented protuberances. The second protuberances 38 are substantially oriented in the cross-machine direction (CD) and may be referred to herein as substantially CD oriented protuberances. The protuberances 22, 38 are generally disposed on the web contacting surface 20 for cooperating with, and structuring of, the wet fibrous web during manufacturing. In a particularly preferred embodiment the web contacting surface 20 comprises a plurality of spaced apart three-dimensional MD oriented protuberances 22 distributed across the web contacting surface 20 of the fabric 10, which together constitute from at least about 15 percent of the web contacting surface, such as from about 15 to about 35 percent, more preferably from about 18 to about 30 percent, and still more preferably from about 20 to about 25 percent of the web contacting surface.

The MD oriented protuberances 22 may extend generally in a first direction along a major axis 25 across one dimension of the fabric 10 in a continuous fashion. In this manner a protuberance 22 may extend from a first lateral edge 17 of the fabric 10 to a second lateral edge 19. In such embodiments the length of the protuberance is dependent upon the length of the fabric 10 and the angle of the protuberance relative to the machine direction (MD). For example, the protuberances 22 may be arranged in a parallel fashion and extend along a major axis 25 at an angle ($\alpha$) relative to the machine direction axis 27. In this manner the protuberances 22 generally have a long direction axis, i.e., the major axis 25, that intersects the machine direction axis 27 to form an element angle ($\alpha$), which may be greater than about 0.5 degrees, such as from about 2.0 to about 15.0 degrees, such as from about 5.0 to about 10.0 degrees. While the MD oriented protuberances 22 illustrated in FIG. 1 are arranged in a parallel fashion and have the same element angle ($\alpha$), the invention is not so limited. In other embodiments the element angle may vary amongst the MD oriented protuberances and in still other embodiments the MD orientated protuberances may intersect one another.

With continued reference to FIG. 1, the web contacting surface 20 may comprise a plurality of valleys 24, which are generally bounded by adjacent MD oriented protuberances 22 and are coextensive with the upper surface plane of the fabric 10. With reference to valley 24*a*, the valley is discrete and bounded on four sides by protuberances 22*a*, 22*b* and 38*a*, 38*b*. In this manner the valley 24*a* has the shape of a parallelogram with end walls formed by a pair of spaced apart CD oriented protuberances 38*a*, 38*b* and sidewalls formed by a pair of spaced apart MD oriented protuberances 22*a*, 22*b*. The valleys 24 are generally permeable to liquids and allow water to be removed from the cellulosic tissue web by the application of differential fluid pressure, by evaporative mechanisms, or both when drying air passes through the embryonic tissue web while on the papermaking fabric 10 or a vacuum is applied through the fabric 10. Without being bound by any particularly theory, it is believed that the arrangement of protuberances and valleys allow the molding of the embryonic web causing fibers to deflect in the z-direction and generate the caliper of, and patterns on the resulting tissue web.

Figure 3:
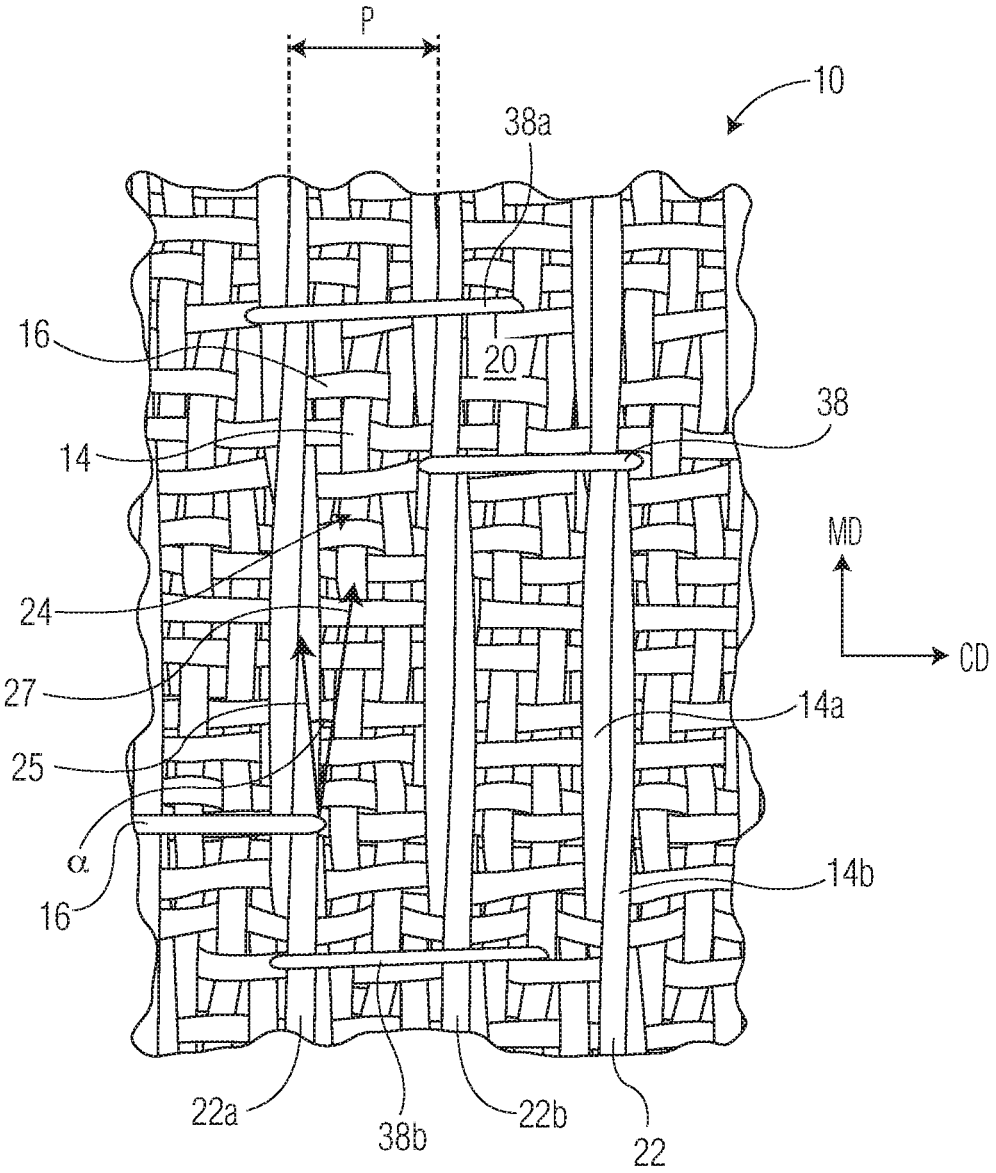
FIG. 3 is a top view of a woven papermaking fabric having a three-dimensional fabric contacting surface according to one embodiment of the present invention.

With reference now to FIG. 3 each of the MD oriented protuberances 22 are formed from two warp filaments 14*a*, 14*b*. The protuberances 22 are arranged generally parallel to one another and extend in a continuous fashion along a first major axis 25, which lies at an angle ($\alpha$) relative to the MD axis 27. A pair of substantially CD oriented protuberance 38*a*, 38*b* are each formed from a single shute filament 16 woven above the corresponding warp filaments 14 and span a pair of spaced apart MD oriented protuberances 22*a*, 22*b*. The pair of substantially CD oriented protuberance 38*a*, 38*b* are spaced apart from each other in the MD of the fabric 10 and form the end walls of a valley 24. The sidewalls of the valley 24 are formed by the pair of spaced apart MD oriented protuberances 22*a*, 22*b*.

The pair of tightly woven warp filaments 14*a*, 14*b* forming the MD oriented protuberance 22 can vary in length, but typically rise over from about 5 to about 50, such as from about 10 to about 30 shute filaments 16, depending on the size and spacing of the shute filaments 16. The pair of warp filaments 14*a*, 14*b* forming a given protuberance 22 overlap one another to a certain extent allowing the end of one warp float 14*a* to tuck under the next machine direction oriented warp float 14*b*. In this manner the protuberances 22 are formed from a pair of warps 14*a*, 14*b* stacked on top of one another in a uniform fashion. As the warps 14*a*, 14*b* tuck under one another they provide the protuberance 22 with a height and form a twill pattern having a twisted rope appearance.

In certain instances the warp filaments 14 forming the MD oriented protuberances 22 have an upper surface that defines a first fabric surface plane and the shute filaments 16 forming the substantially CD oriented protuberances 38 has an upper surface that defines a second fabric surface plane. Similarly, the interwoven warp and shute filaments 14, 16 forming the valleys 24 have an upper surface that defines the valley bottom plane, which generally lies below both the first and second fabric planes.

The shape of the MD protuberances, such as the height, width and cross-sectional shape, may vary depending on the size, shape and number of warp filaments that make up the protuberance. For example, as illustrated in FIG. 3, a pair of warp filaments 14*a*, 14*b* are bundled together to form a protuberance 22*a*, which in certain instances may have a semi-circular cross-sectional shape. Further, the upper surface of the warp filaments 14*a*, 14*b* lie in an upper surface plane above the valley bottom plane in the z-direction providing the protuberance 22*a* with a height. In certain instances the height of the protuberances may be altered by selecting warp filaments of different sizes and shapes and by the number of warps forming a given protuberance.

The MD protuberance height may range from about 0.1 to about 5.0 mm, more preferably from about 0.2 to about 3.0 mm, or even more preferably from about 0.5 to about 1.5 mm. Of course, it is contemplated that the height can be outside of this preferred range in some embodiments. Further, while the height of the protuberances is generally illustrated herein as being substantially uniform amongst the protuberances, the invention is not so limited and the protuberances may have different heights.

The MD protuberance width may also vary depending on the construction of the fabric and its intended use. For example, the width of the protuberances may be influenced by the number of warp filaments used to form the protuberance, as well as the diameter of the filament used for a given warp float. In certain embodiments a protuberance may comprise from 2 to 8, such as 4 to 6, warp filaments. In other instances the warp filaments may have a diameter from about 0.2 to about 0.7 mm, such as from about 0.3 to about 0.5 mm and the protuberances may be woven from 2 to 6 adjacent warp filaments.

Protuberance width is generally measured normal to the principal dimension of the protuberance at a given location. Where the protuberance has a generally square or rectangular cross-section, the width is generally measured as the distance between the two planar sidewalls that form the protuberance. In those cases where the protuberance does not have planar sidewalls the width is measured at the point that provides the greatest width for the configuration of the protuberance. For example, the width of a protuberance not having two planar sidewalls may be measured along the base of the protuberance.

In one embodiment the MD protuberance may have a square cross-sectional shape, where the width and height are substantially equal and vary from about 0.5 and 3.5 mm, more preferably from about 0.5 to about 1.5 mm, and in a particularly preferred embodiment between from about 0.7 to about 1.0 mm. However, it is to be understood that because the protuberances are formed from woven filaments having generally circular or oval cross-sectional shapes, the cross-sectional shape of the resulting protuberance may not be perfectly rectilinear, but may have some other cross-sectional shape that is approximately rectilinear.

With reference again to FIG. 3, the CD protuberance 38 may be formed from a single shute filament 16, which may span a pair of adjacent MD protuberances 22. In other instances the CD protuberances may comprise a single shute filament woven above its corresponding warp filament along its entire length and traverses at least one MD oriented protuberances and have a length, measured along the long axis of the protuberance, of about 0.5 mm or greater, such as from about 0.5 to about 6.0 mm. In other instances the CD protuberance may be formed from two or more shute filaments and its length, generally measured along the long axis of the protuberance, may be about 0.5 mm or greater, such as from about 0.5 to about 10.0 mm, such as from about 1.0 to about 8.0 mm, such as from about 2.0 to about 6.0 mm. Of course, it is contemplated that the length of the CD protuberance can be outside of the preferred range in some embodiments and still be within the scope of this disclosure.

The spacing and arrangement of protuberances may vary depending on the desired tissue product properties and appearance. If the individual protuberances are too high, or the valley area is too small, the resulting sheet may have excessive pinholes and insufficient compression resistance, CD stretch, and CD Tensile Energy Absorption (TEA), and be of poor quality. Further, tensile strength may be degraded if the span between adjacent MD protuberances greatly exceeds the fiber length. Conversely, if the spacing between adjacent MD protuberances is too small the tissue will not mold completely into the fabric negatively affecting important sheet properties such as sheet caliper and cross-machine direction properties such as stretch and tensile energy absorption.

In one embodiment the web contacting surface comprises a plurality of MD oriented protuberances extending continuously throughout one dimension of the fabric and each of the plurality of MD protuberances are spaced apart from one another. Thus, the MD oriented protuberance may be spaced apart across the entire cross-machine direction of the fabric or may run diagonally relative to the machine direction and have an element angle from about 2 to about 10 degrees. Further the MD oriented protuberances may all be similarly shaped and sized.

The web contacting surface further comprises a plurality of substantially CD oriented protuberances, where the CD protuberances are discrete and span at least one MD oriented protuberance and have a length from about 0.5 to about 8.0 mm.

The MD oriented protuberances generally define valleys there between, where the valleys have a valley depth greater than about 0.50 mm, such as from about 0.50 to about 2.00 mm, such as from about 0.50 to about 1.50 mm. In certain instances the valleys may be further bound by CD orientated protuberances, which may span a pair of adjacent MD orientated protuberances and form the valley end walls. In such embodiments the valleys are generally discrete, having sidewalls defined by the spaced part MD orientated protuberances and end walls defined by spaced apart CD orientated protuberances. The discrete valleys may have a parallelogram shape and may comprise a significant portion of the projected surface area of the web contacting surface of the fabric, such as greater than 50 percent of the projected surface area of the web contacting surface of the fabric, such as from about 50 to 75 percent.

Several exemplary woven papermaking fabrics are illustrated in the attached figures. The illustrated fabrics are woven so as to form a plurality of MD oriented protuberances and a plurality of substantially CD oriented protuberances, which together define valleys there between. The illustrated fabrics generally have valley depths greater than about 0.30 mm, more preferably greater than about 0.35 mm and still more preferably greater than about 0.40 mms, such as from about 0.30 to about 1.0 mm. The fabrics are woven such that the valley sidewalls are relatively steep and provide the fabric with a wall angle greater than about 20 degrees and more preferably greater than about 22 degrees and still more preferably greater than about 24 degrees, such as form about 20 to about 45 degrees and more preferably from about 22 to about 40 degrees. The dimensions of various papermaking fabrics prepared according to the present invention are summarized in the table below.

TABLE 1

Figure 5A:
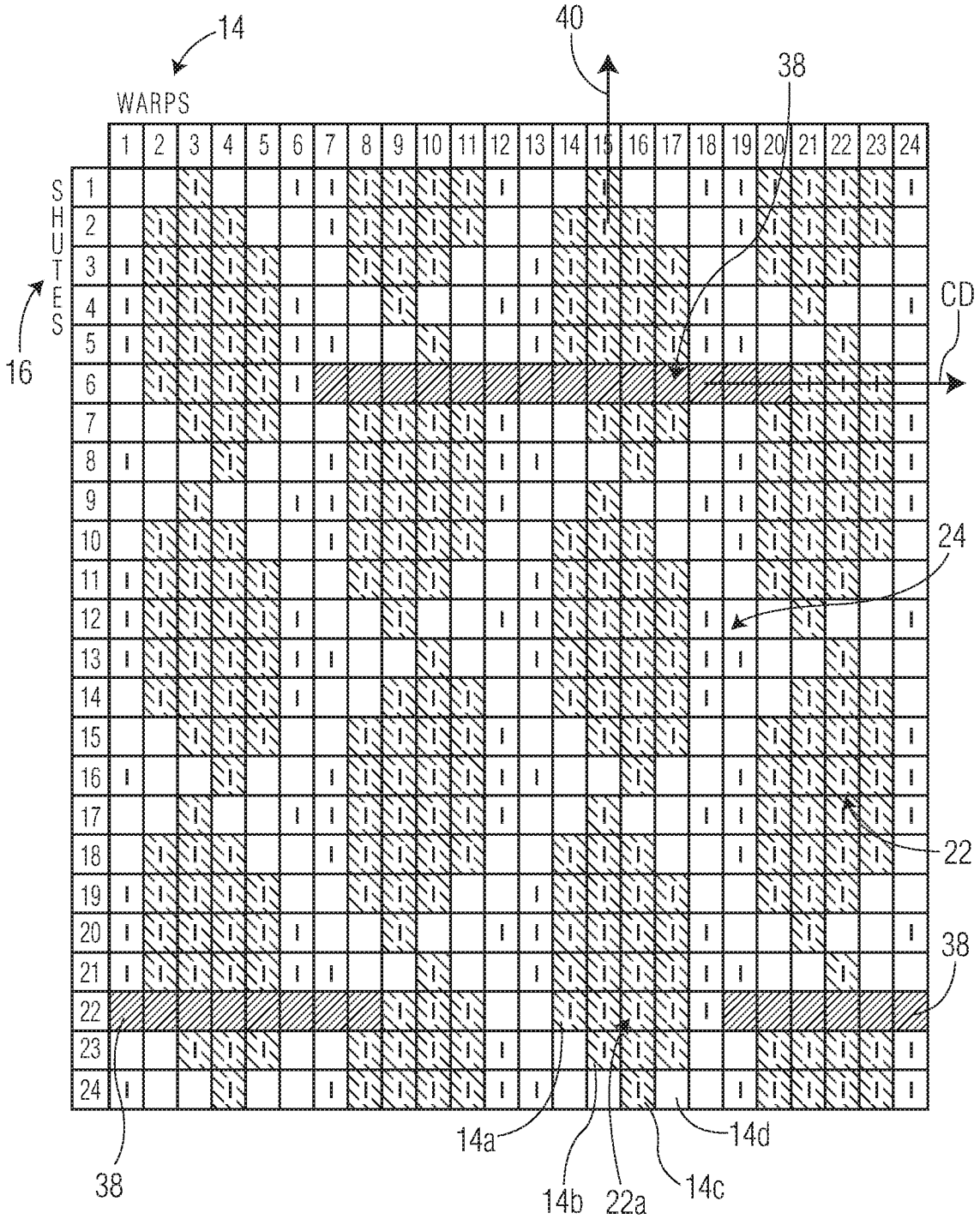
FIG. 5A illustrates another weave pattern useful in the manufacture of a woven papermaking fabric according to the present invention.
Figure 5B:
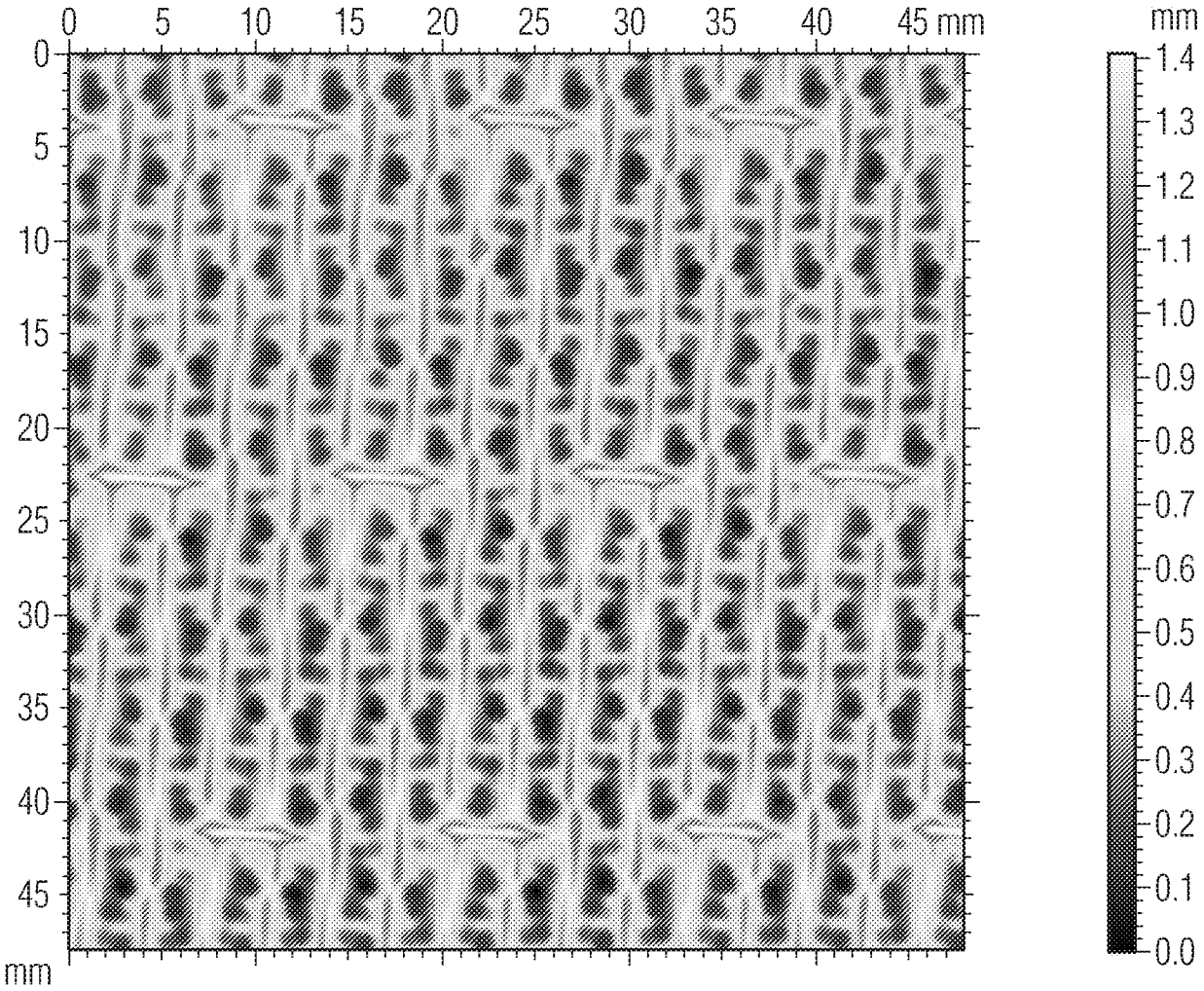
FIG. 5B is a profilometry scan of a fabric woven according to the weave pattern of FIG. 5A.

| Illustrated Fabric | Valley Depth (mm) | Wall Angle (°) | Element Width (mm) |
|---|---|---|---|
| FIG. 5B | 0.858 | 32.2 | 3.25 |

TABLE 1-continued

Figure 6A:
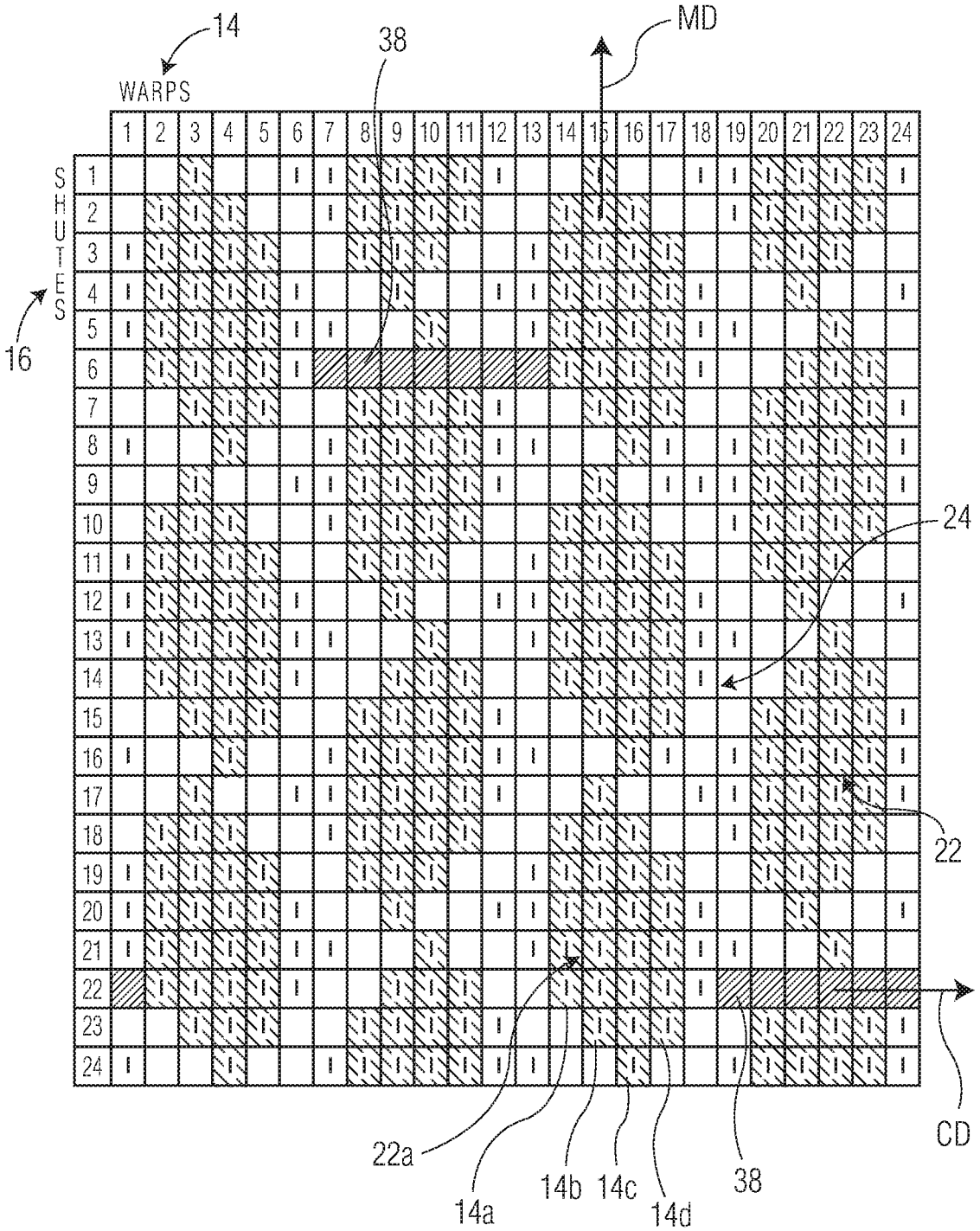
FIG. 6A illustrates another weave pattern useful in the manufacture of a woven papermaking fabric according to the present invention.
Figure 6B:
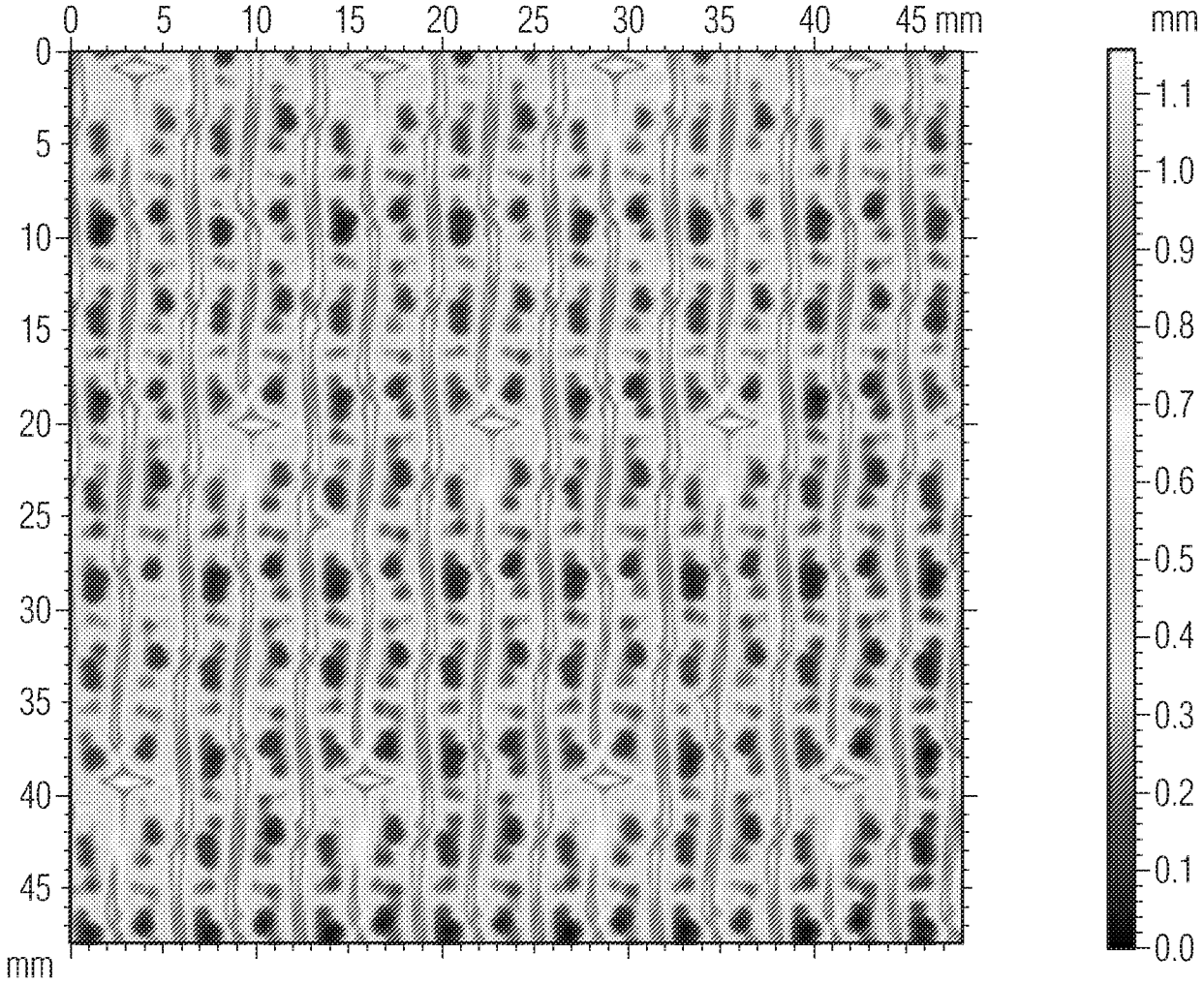
FIG. 6B is a profilometry scan of a fabric woven according to the weave pattern of FIG. 6A.

| Illustrated Fabric | Valley Depth (mm) | Wall Angle (°) | Element Width (mm) |
|---|---|---|---|
| FIG. 6B | 0.848 | 32.8 | 3.18 |

Exemplary weave patterns and methods of manufacturing a woven papermaking fabric will now be described. In one embodiment, the papermaking fabric could be manufactured by providing a first set of filaments and a second set of filaments that are woven in a weave pattern. The first set of filaments can serve as warp filaments in a loom and the second set of filaments can serve as shute filaments in a loom. The method can additionally include weaving the shute filaments with the warp filaments in a lateral direction to provide a web contacting surface of the woven papermaking fabric and a machine contacting surface of the woven papermaking fabric and to provide a plurality of MD oriented protuberances and a plurality of substantially CD oriented protuberances on the web contacting surface of the woven papermaking fabric. Weaving the shute filaments with the warp filaments can be accomplished by following weave patterns.

Figure 4A:
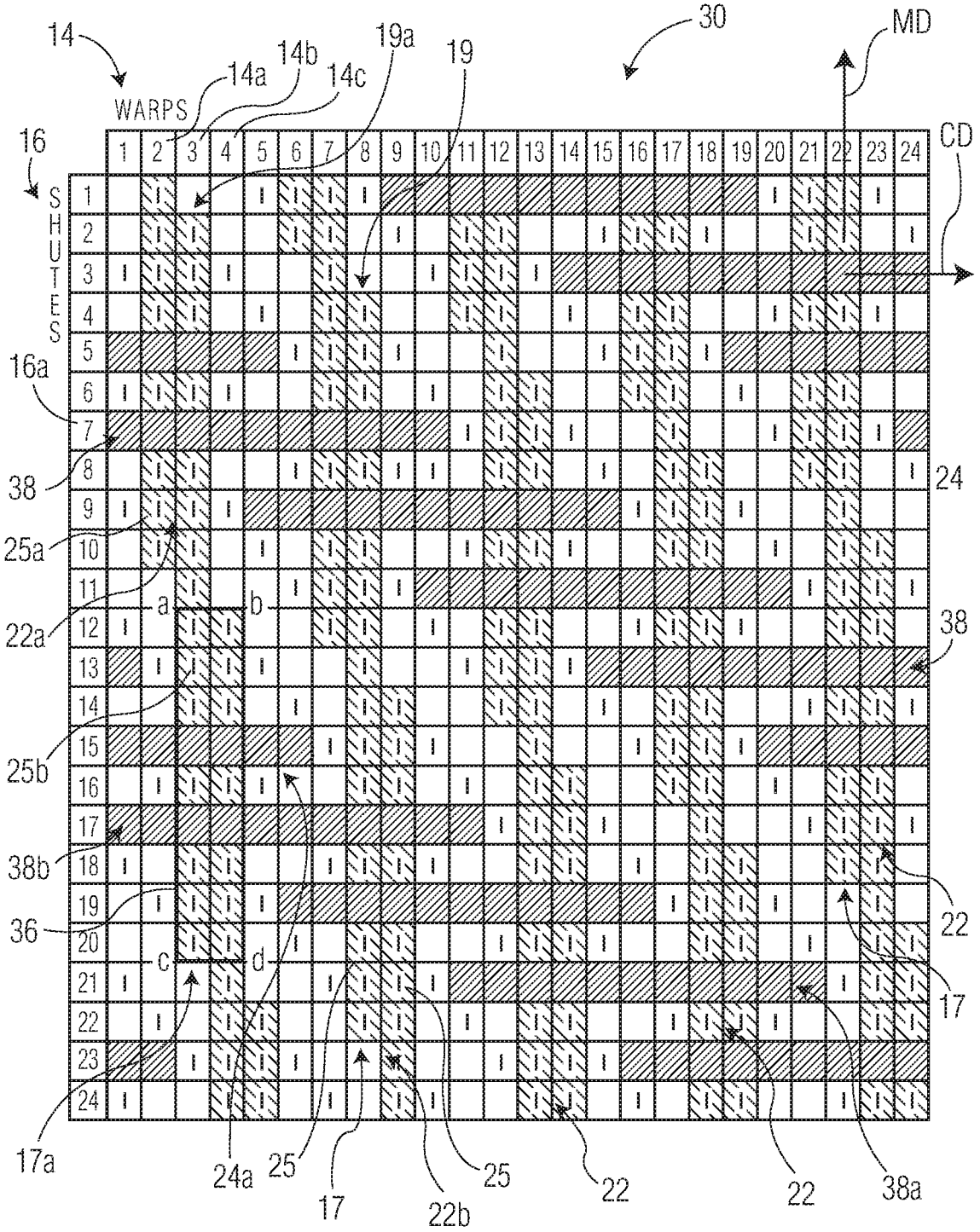
FIG. 4A illustrates a weave pattern useful in the manufacture of a woven papermaking fabric according to the present invention.
Figure 4B:
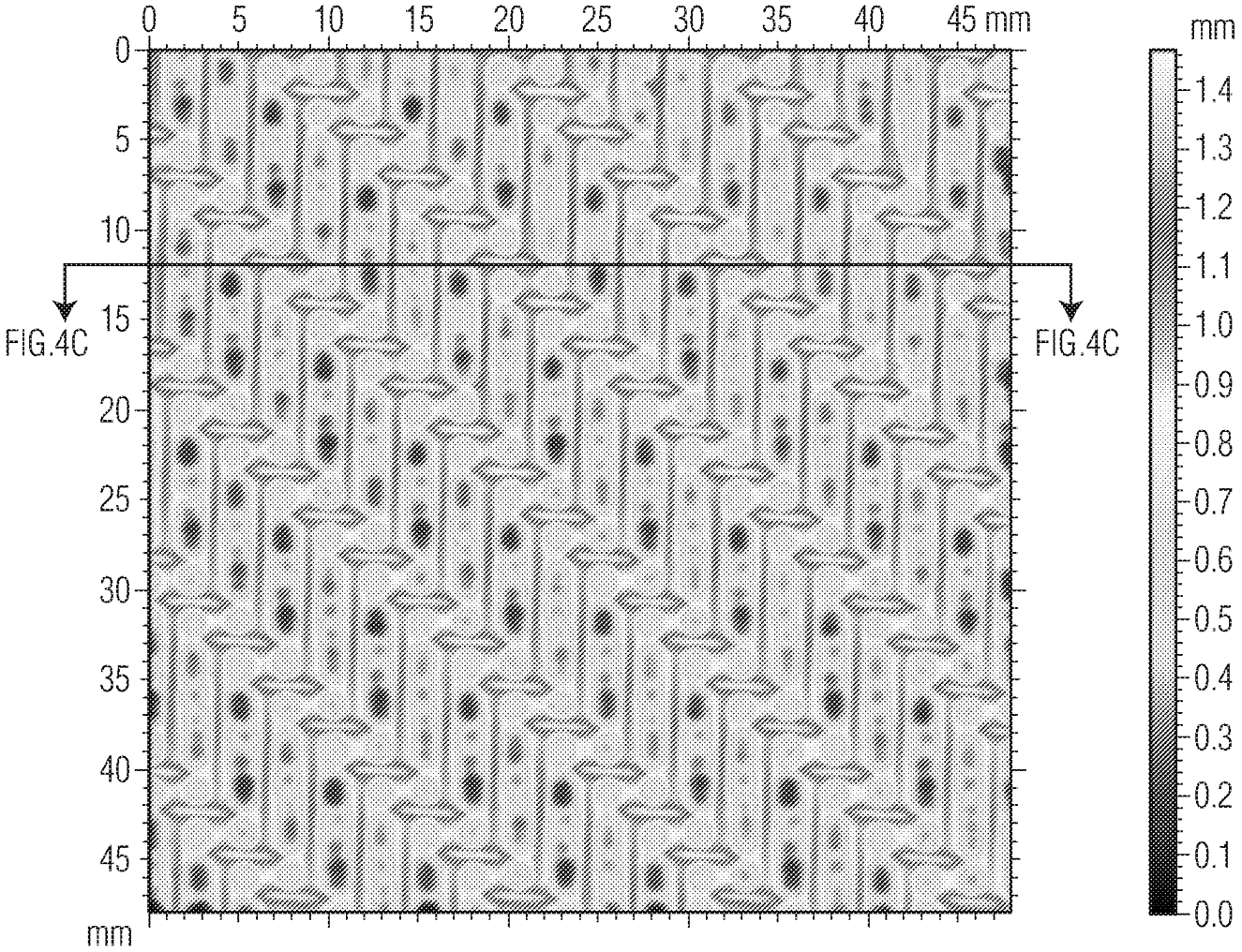
FIG. 4B is a profilometry scan of a fabric woven according to the weave pattern of FIG. 4A.
Figure 4C:
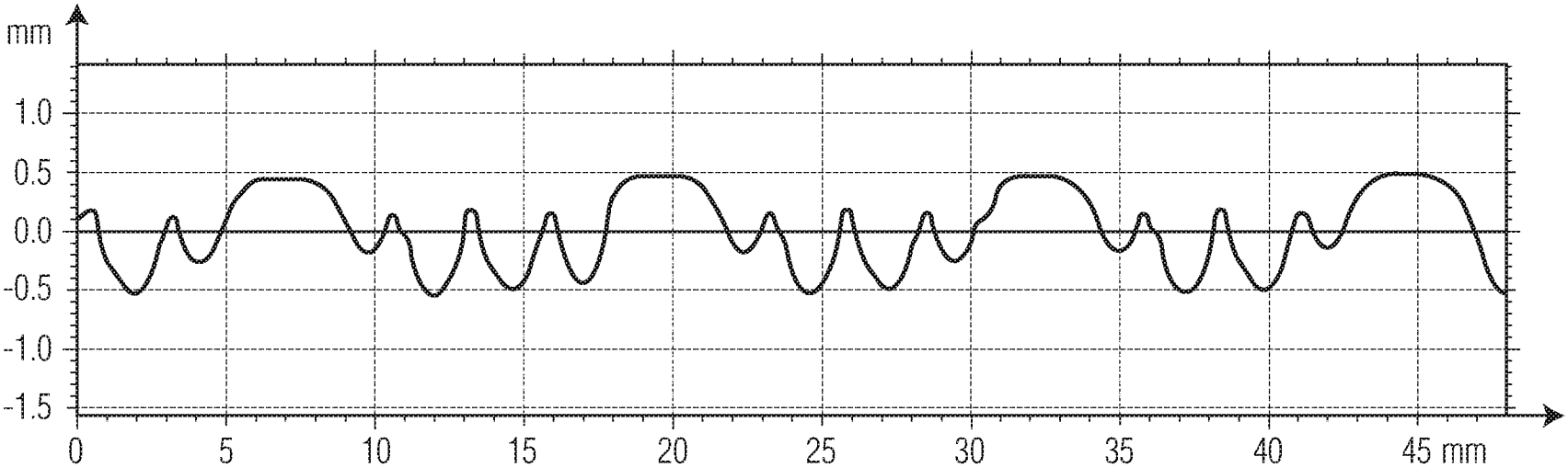
FIG. 4C is a cross-section of the profilometry scan of FIG. 4B through the line 4C-4C.

Various weave patterns can be used to guide the weaving of the shute filaments with the warp filaments and provide machine direction oriented protuberances that are stabilized on the papermaking fabric. One exemplary weave pattern 30 is shown in FIG. 4A. The weave pattern generally comprises a single unit cell, which may be combined with other unit cells to form a weave pattern. Unit cells can be repeated as many times as desired in the machine direction and/or the cross-machine direction to form a desired pattern in a papermaking fabric. The skilled artisan will be able to envision alternate means of arranging the unit cell of FIG. 4A to create a papermaking fabric having a pattern other than that illustrated in FIG. 4A.

The weave pattern of FIG. 4A will now be described in detail, however, the principles of weave patterns may be adapted to form a broad range of unit cells that may be combined to form a fabric according to the present invention. The weave pattern 30 can include a plurality of warp filaments 14 generally aligned in the machine direction (MD) and a plurality of shute filaments 16 generally aligned in the cross-machine direction (CD). The weave pattern can be configured on a loom (not pictured) such that the resulting web contacting surface of the papermaking fabric will be facing out from the page, and the machine contacting surface of the papermaking fabric will be facing into the page. Of course, it is contemplated that a weave pattern could be configured in the opposite orientation on a loom. Each interchange of a specific warp filament 14 and a specific shute filament 16 of the weave pattern 30 that includes a vertical line segment (or a capital letter "I") provides a notation that the warp filament 16 is above top shute (and above bottom shute if present) at that interchange. For example, the interchange of warp filament No. 2 and shute filament No. 1 includes such a vertical line segment in FIG. 4A, and thus, warp filament No. 2 is woven above shute filament No. 1. In some circumstances interchanges of warp filaments 14 and shute filaments 16 that have the vertical line segment (or capital letter "I") that will lead to the development of a MD oriented protuberance 22 are also shaded with a cross-hatching pattern for purposes of clarity of perceiving the MD oriented protuberances 22 of the weave pattern 30 provided herein.

In other instances interchanges of warp filaments 14 and shute filaments 16 are woven with the shute filament 16 above the corresponding warp filament 14 resulting in the development of a CD oriented protuberance 38. For example, the shute filament No. 1 is woven above the warp filaments Nos. 9-19 to develop a CD oriented protuberance 38, the presence of which is denoted by a cross-hatching pattern for purposes of clarity of perceiving the CD oriented protuberances.

With continued reference to FIG. 4A, the MD oriented protuberances 22 are generally defined by portions of the weave pattern 30 in which a plurality of adjacent warp/shute filament interchanges are woven such that the warp filaments 14 are woven above their respective shute filaments 16. The exception being those portions of the protuberance where the shute filament forming a CD oriented protuberance is woven above the protuberance forming warp filaments. For example, the shute filament 16*a* forming the CD oriented protuberance 38*a* is woven above the warps 14*a*, 14*b* forming the MD oriented protuberance 22*a*.

The MD oriented protuberances can be of various lengths and/or widths to provide various shapes, as will be discussed in more detail below. The MD oriented protuberances are generally spaced apart from one another and may extend continuously across one dimension of the fabric. Further, the MD oriented protuberances may be arranged substantially parallel to one another such that no two MD oriented protuberances intersect one another. As shown in FIG. 4A, the weave pattern 30 includes a first MD oriented protuberance 22*a* which forms a line element and is spaced apart from a second similarly shaped second MD oriented protuberance 22*b*.

Between the first and second protuberances 22*a*, 22*b* a valley 24*a* is formed. The width of the valley, measured generally in the cross-machine direction (CD), may be from two to ten, such as from four to six, warps wide. In the embodiment illustrated in FIG. 4A, the valley 24*a* is three warps wide at its widest point. The valley may comprise a variety of different weave patterns to stabilize the resulting fabric and increase the height of the protuberances. For example, the valley 24*a* of FIG. 4A comprises warp/shute filament interchanges in which the warp filaments 14 are woven both above and below their respective shute filaments 16.

The machine direction (MD) oriented protuberances each comprise a first and a second warp filament—protuberance 22*a* comprises warps 14*a*, 14*b*—arranged in a pair-wise fashion. The pair-wise warp filaments 14*a*, 14*b* are directly adjacent warps (illustrated as warp positions Nos. 2 and 3) in the weave pattern 30 and make up protuberance forming portions 25*a*, 25*b* in which the warp filament 14*a*, 14*b*, is woven above its respective shute filament. Further, each protuberance forming portion 25 has a first proximal end 17 and first distal end 19 spaced apart in the machine direction (MD). Looking at a specific warp filament 14*b* within the weave pattern 30 in a bottom-to-top fashion, the float proximal end 17*a* can be the interchange of a specific shute filament and a specific warp filament that begins a series of adjacent interchanges in which the warp filaments are woven above that specific shute filament. The float distal end 19*a* can be the interchange of a specific shute filament and a specific warp filament that ends a series of adjacent interchanges in which the warp filaments are woven above that specific shute filament. In other words, a shute filament float proximal end can be where the shute filament is woven from a web contacting surface to the machine contacting surface of the fabric and a shute filament float distal end can be where the shute filament is woven from a machine contacting surface to the web contacting surface of the fabric.

As further illustrated in FIG. 4A, the weave pattern 30 is configured such that the pair of adjacent warp filaments 14 overlap one another along a portion of the protuberance 22. The overlap portion 36, outlined by the box abcd, is referred to herein as a "paired portion" and comprises a portion of the protuberance 22 where adjacent warp filaments 14*b*, 14*c* are woven above the corresponding shute filament. In the illustrated embodiment the paired portion 36 has a float length of nine (traversing shute position Nos. 12-20), although the length may vary. For example, the paired portion may have a float length of two or greater, more preferably three or greater, and still more preferably four or greater, such as from two to twenty and more preferably from two to fourteen and still more preferably from four to ten.

The length of the MD oriented protuberance forming portions 25, that is the portion of a warp 14 filament woven above the shute 16 floats to form a protuberance 22, may vary. For example, the warp shutes forming the protuberance may have a float length greater than 4, such as from 4 to 50, more preferably from 5 to 30 and still more preferably from 7 to 20. In the weave pattern 30 illustrated in FIG. 4A the shute 14*b* forming the protuberance forming portion 25*a* has a float length of nineteen (traversing shute position Nos. 2-20).

With continued reference to the weave pattern 30 of FIG. 4A, in addition to MD oriented protuberance 22, the weave pattern comprises CD oriented protuberances 38 formed from a single shute filament 16 woven above the corresponding warp filament 14. In the illustrated embodiment the shute filaments 16 forming the CD oriented protuberances 38 are woven in a regular, repeating pattern and yield discrete CD oriented protuberances 38. The CD oriented protuberances 38 are arranged in a staggered pattern, spaced apart from one another in the MD by one shute filament 16. The CD oriented protuberances 38 have a float length of 11, for example CD oriented protuberance 38*a* comprises shute filament position No. 21 woven above warp filament 14 position Nos. 11-21. The CD oriented protuberances 38 generally traverse two adjacent MD oriented protuberances 22 and form the end walls of valleys 24 disposed there between. One skilled in the art will appreciate that the foregoing pattern of weaving CD oriented protuberance is non-limiting and that other patterns may be envisioned.

With reference now to FIG. 5A, which illustrates another weave pattern 30 for a papermaking fabric of the present invention, the MD oriented protuberances 22 are woven from warp filaments 14 woven above their corresponding shute filaments 16 and are generally aligned with the MD axis of the fabric. The weave pattern 30 yields MD oriented protuberances 22 that are continuous in the MD and generally arranged parallel to, and equally spaced apart from, each other. MD oriented protuberances generally comprise a plurality of adjacent warp filaments woven above their corresponding shute filaments. For example, with reference to MD oriented protuberances 22*a*, four immediately adjacent warp filaments 14*a*-14*d* form the protuberance. The protuberance 22*a* is woven such that it is a maximum width of four warp filaments and a minimum of one shute filament.

The MD oriented protuberances 22 are continuous, not discrete, and formed of multiple warp filaments 14 grouped together and supported by multiple shute filaments 16. The longest warp float is over seven shutes. When weaving the pattern 30, two different shute diameters may be utilized, both of which may be larger than the warp diameter even though this is not a requirement of the fabric structure. While the MD oriented protuberances may be aligned with the MD axis, in certain instances the orientation may vary depending on certain factors, such as pick count, and the resulting MD oriented protuberances may be aligned along a slight angle, up to about 15 degrees, with respect to the machine direction.

The protuberances 22 are spaced apart from one another to define valleys 24 there between. The width of the valleys 24 in the illustrated embodiment generally ranges from two to four warp widths. The valley sidewalls are generally formed by the spaced apart, adjacent, MD oriented protuberances and the end walls are formed by CD oriented protuberances. In the illustrated embodiment CD oriented protuberances 38 are formed from a single shute filament 16 woven above its corresponding warp filaments 14 and having a float length of 14. In this manner the CD oriented protuberances 38 may be formed from a shute filament that is woven above the warp filaments 14 forming two adjacent MD oriented protuberances 22. This may result in the CD oriented protuberances having an upper surface lying in an upper surface plane that is above the surface plane defined by the upper surface of the MD oriented protuberances.

With reference now to FIG. 6A, which illustrates yet another weave pattern 30 for a papermaking fabric of the present invention, the MD oriented protuberances 22 are woven from warp filaments 14 woven above their corresponding shute filaments 16 and are generally aligned with the MD axis of the fabric. The weave pattern 30 yields MD oriented protuberances 22 that are continuous in the MD and generally arranged parallel to, and equally spaced apart from, each other. MD oriented protuberances generally comprise a plurality of adjacent warp filaments woven above their corresponding shute filaments.

The pattern used to form the MD oriented protuberances 22 of FIG. 6A is similar to that FIG. 5A. The MD oriented protuberances 22 are continuous, not discrete, and formed of multiple warp filaments 14 grouped together and supported by multiple shute filaments 16. The longest warp float is over seven shutes. The protuberances 22 are spaced apart from one another to define valleys 24 there between, which generally have a width from two to four warp widths. The valleys 24 are generally continuous and bound on either side by adjacent, spaced apart, MD oriented protuberances 22. The CD oriented protuberances 38 generally do not span the entire width of a valley and as such do not form valley end walls.

In the illustrated embodiment of FIG. 6A, the CD oriented protuberances 38 are formed from a single shute filament 16 woven above its corresponding warp filaments 14 and having a float length of seven. In this manner the CD oriented protuberances 38 are formed from a shute filament that is woven above the warp filaments 14 forming only a single MD oriented protuberance 22. This generally results in CD oriented protuberances having a relatively short length (measured along the CD-axis of the element) and an upper surface lying in an upper surface plane that is above the surface plane defined by the upper surface of the MD oriented protuberances. While in certain embodiments the CD oriented protuberances have an upper surface lying in an upper surface plane that is above the surface plane defined by the upper surface of the MD oriented protuberances the invention is not so limited and the two protuberances may have upper surfaces that lie in substantially the same plane, or the upper surface of the CD protuberances may lie below the upper surface of the MD protuberance. Further, within a given fabric the protuberances may be woven in different patterns such that some of the protuberances are co-planar and others are out of plane with one another.

Test Method

Valley Depth, Valley Width and Wall Angle

The valley depth and angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a sample were created using an FRT MicroSpy® Profile profilometer (FRT of America, LLC, San Jose, CA) and then analyzing the image using Nanovea® Ultra software version 7.4 (Nanovea Inc., Irvine, CA). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 pin spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

The foregoing yields three values indicative of the fabric topography—valley depth, valley width and wall angle. Valley width is the Psm value having units of mms (mm). Valley depth is the difference between C2 and C1 values, also referred to as S90, having units of mms (mm). Valley angle is the Pdq value having units of degrees (°).

Element Angle

Before measuring element angle, care must be taken to ensure that fabric is properly oriented before the surface map obtained by the FRT MicroSpy profilometer, as described above. To ensure that the warp filaments are aligned with the MD axis of the fabric and the shutes filaments aligned with the CD axis, a shute filament from the bottom of the fabric can be pulled by hand completely across the CD of the fabric to create a single shute filament aligned with the fabric CD axis. The single shute filament may then used as a guide to align the fabric on the profilometer stage and a profilometer scan of the fabric may be obtained as described above.

Once a scan of the fabric is completed and the .sdf is analyzed as described above, the element angle is determined using the "texture direction" function under the "Studies" tab of the Nanovea® Ultra software. Once the "texture direction" is selected, the angle of the three most elevated features on the fabric surface will be reported. To calculate the element angle, the first value is selected and subtracted from 90. The resulting value is the element angle, having units of degrees.

Embodiments

In a first embodiment the present invention provides a woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a plurality of MD oriented protuberances formed from two or more warp filaments woven above their corresponding shute filaments, each of the plurality of MD oriented protuberances spaced apart from one another to define valleys there between, and a plurality of discrete CD oriented protuberances formed from at least one shute filament woven about a corresponding warp filament.

In a second embodiment the present invention provides the woven papermaking fabric of the first embodiment wherein the CD oriented protuberance has an upper surface lying in a first upper surface plane and the MD oriented protuberance has an upper surface lying in a second upper surface plane, wherein the first upper surface plane is above the second upper surface plane.

In a third embodiment the present invention provides the woven papermaking fabric of the first or second embodiment wherein the valleys are continuous.

In a fourth embodiment the present invention provides the woven papermaking fabric of the first through third embodiments wherein valleys are discrete and have a pair of opposed end walls formed from two spaced apart CD oriented protuberances and a pair of opposed sidewalls formed from two spaced apart MD oriented protuberances.

In a fifth embodiment the present invention provides the woven papermaking fabric of the first through fourth embodiments wherein each of the plurality of MD oriented protuberances are continuous.

In a sixth embodiment the present invention provides the woven papermaking fabric of the first through fifth embodiments wherein each of the plurality of MD oriented protuberances have an element angle from 0 to ±20 degrees.

In a seventh embodiment the present invention provides the woven papermaking fabric substantially of any one of the foregoing embodiments wherein the protuberances have an element angle from 0.5 to 10 degrees.

In an eighth embodiment the present invention provides the woven papermaking fabric substantially of any one of the foregoing embodiments wherein the web contacting surface has a valley depth from about 0.30 to about 1.00 mm.

In a ninth embodiment the present invention provides the woven papermaking fabric substantially of any one of the foregoing embodiments wherein each of the plurality of MD oriented protuberances have a height from about 0.2 to about 5.0 mm.

In a tenth embodiment the present invention provides the woven papermaking fabric of any one of the foregoing embodiments wherein the plurality of MD oriented protuberances are woven in a twill pattern and comprise from 2 to 6 directly adjacent warp filaments and each of the warp filaments has a float length from 4 to 40.

In an eleventh embodiment the present invention provides the woven papermaking fabric of any one of the foregoing embodiments wherein MD protuberances are woven in a twill pattern and comprise from 2 to 6 directly adjacent warp filaments and each of the warp filaments has a float length from 4 to 40 and each of the warp filaments overlap one another to form a paired portion having a float length from 2 to 8.

In a twelfth embodiment the present invention provides the woven papermaking fabric of the eleventh embodiment wherein each of the plurality of discrete CD oriented protuberances contact at least one MD oriented protuberance.

In a thirteenth embodiment the present invention provides the woven papermaking fabric of the eleventh or twelfth embodiment wherein each of the plurality of discrete CD oriented protuberances comprises a single shute filament having a length from about 1.0 to about 4.0 m.

In a fourteenth embodiment the present invention provides the woven papermaking fabric of any one of the eleventh through thirteenth embodiments wherein each of the plurality of discrete CD oriented protuberances are parallel to one another and have substantially similar lengths.

In a fifteenth embodiment the present invention provides the woven papermaking fabric of any one of the foregoing embodiments wherein the MD oriented protuberances intersect one another.

In a sixteenth embodiment the present invention provides the woven papermaking fabric of any one of the foregoing embodiments wherein the CD oriented protuberances and the MD oriented protuberances have upper surfaces that are substantially coplanar.

In a seventeenth embodiment the present invention provides the woven papermaking fabric of any one of the foregoing embodiments wherein each of the plurality of MD orientated protuberances are substantially similar to one another and each of the plurality of CD orientated protuberances are substantially similar to one another.

What is claimed is:

1. A woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a plurality of MD oriented protuberances formed from two or more warp filaments woven above their corresponding shute filaments, each of the plurality of MD oriented protuberances spaced apart from one another to define valleys having a depth of 0.5 mm or greater there between, and a plurality of discrete CD oriented protuberances formed from at least one shute filament woven about a corresponding warp filament.

2. The woven papermaking fabric of claim 1 wherein the CD oriented protuberance has an upper surface lying in a first upper surface plane and the MD oriented protuberance has an upper surface lying in a second upper surface plane, wherein the first upper surface plane is above the second upper surface plane.

3. The woven papermaking fabric of claim 1 wherein the valleys are continuous.

4. The woven papermaking fabric of claim 1 wherein valleys are discrete and have a pair of opposed end walls formed from two spaced apart CD oriented protuberances and a pair of opposed sidewalls formed from two spaced apart MD oriented protuberances.

5. The woven papermaking fabric of claim 1 wherein each of the plurality of MD oriented protuberances are continuous.

6. The woven papermaking fabric of claim 1 wherein each of the plurality of MD oriented protuberances have an element angle from 0 to ±20 degrees.

7. The woven papermaking fabric of claim 1 wherein the each of the plurality of MD oriented protuberances have an element angle from 2 to 10 degrees.

8. The woven papermaking fabric of claim 1 wherein the web contacting surface has a valley depth from 0.5 to 2.0 mm.

9. The woven papermaking fabric of claim 1 wherein each of the plurality of MD oriented protuberances have a height from about 0.2 to about 5.0 mm.

10. The woven papermaking fabric of claim 1 wherein the plurality of MD oriented protuberances are woven in a twill pattern.

11. The woven papermaking fabric of claim 1 wherein each of the plurality of MD oriented protuberances comprises from 2 to 6 warp filaments.

12. The woven papermaking fabric of claim 1 wherein each of the plurality of discrete CD oriented protuberances contact at least one MD oriented protuberance.

13. The woven papermaking fabric of claim 1 wherein each of the plurality of discrete CD oriented protuberances contact at least two or more MD oriented protuberance.

14. The woven papermaking fabric of claim of 1 wherein each of the MD-oriented protuberances are parallel to one another and have substantially similar height and width.

15. The woven papermaking fabric of claim 1 wherein each of the plurality of discrete CD oriented protuberances comprises a single shute filament having a length from about 1.0 to about 4.0 mm.

16. The woven papermaking fabric of claim 1 wherein each of the plurality of discrete CD oriented protuberances are parallel to one another and have substantially similar lengths.

17. A woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having first and second spaced apart MD oriented protuberances and first and second CD oriented protuberances spaced apart from each other in the MD and intersecting the first and second MD oriented protuberances, the first and second MD oriented protuberances and the first and second CD oriented protuberances defining a discrete parallelogram shaped valley having a depth of 0.5 mm or greater there between.

18. The woven papermaking fabric of claim 17 wherein the first and second MD oriented protuberances are parallel to one another and have an element angle from 2 to 10 degrees.

19. The woven papermaking fabric of claim 17 wherein the web contacting surface has a valley depth from 0.5 to 2.0 mm.

20. The woven papermaking fabric of claim 17 wherein the web contacting surface has a valley width from about 0.5 to about 4.0 mm.

21. The woven papermaking fabric of claim 17 wherein the first and second MD oriented protuberances form valley sidewalls having a wall angle from about 22 to about 30 degrees.

22. The woven papermaking fabric of claim 17 wherein the first and second CD oriented protuberances are parallel to one another and have a width from about 1.0 to about 5.0 mm.

23. The woven papermaking fabric of claim 17 wherein the first and second MD oriented protuberances are woven in a twill pattern.

24. The woven papermaking fabric of claim 17 wherein the first and second MD oriented protuberances comprise from 2 to 6 warp filaments.

25. A woven papermaking fabric having a machine direction axis and a cross-machine direction axis, the fabric comprising: a plurality of machine direction (MD) oriented warp filaments and a plurality of cross-machine direction (CD) oriented shute filaments, the shute filaments being interwoven with warp filaments to provide a machine contacting fabric side and opposed web contacting fabric side, the web contacting fabric side having a pair of spaced apart MD oriented protuberances woven from two or more adjacent warp filaments and a pair of spaced apart CD oriented protuberances comprising at least one shute filament woven over the two or more adjacent warp filaments forming the MD oriented protuberance, the at least one shute filament having an upper surface lying in a first fabric upper surface plane, wherein the pairs of MD and CD orientated protuberances define a valley having a depth of 0.5 mm or greater there between.

26. The woven papermaking fabric of claim 25 wherein the two or more adjacent warp filaments forming the MD protuberance have an upper surface lying in a second fabric upper surface plane and wherein the second fabric upper surface plane is below the fabric upper surface plane.

27. The woven papermaking fabric of claim 25 wherein the MD oriented protuberance has an element angle from 2 to 10 degrees.

28. The woven papermaking fabric of claim 25 wherein the CD oriented protuberance has a width from about 1.0 to about 2.0 mm.

29. The woven papermaking fabric of claim 25 wherein the first and second MD oriented protuberances are woven in a twill pattern.

30. The woven papermaking fabric of claim 25 wherein the first and second MD oriented protuberances comprise from 2 to 6 warp filaments.

* * * * *